US008328821B2

(12) United States Patent
Sanchez-Martinez et al.

(10) Patent No.: US 8,328,821 B2
(45) Date of Patent: Dec. 11, 2012

(54) HAIR-REMOVAL APPLIANCE WITH DIFFERENT TOOL ATTACHMENTS

(75) Inventors: Pedro Sanchez-Martinez, Kronberg/Taunus (DE); Michael Klotz, Schöneck (DE); Ralf Dorber, Oberursel (DE); Klaus Ramspeck, Langen (DE); Thomas Schamberg, Usingen (DE); Christof Ungemach, Frankfurt (DE)

(73) Assignee: Braun GmbH, Kronberg (DE)

( * ) Notice: Subject to any disclaimer, the term of this patent is extended or adjusted under 35 U.S.C. 154(b) by 339 days.

(21) Appl. No.: 12/097,480

(22) PCT Filed: Dec. 1, 2006

(86) PCT No.: PCT/EP2006/011543

§ 371 (c)(1),
(2), (4) Date: Nov. 18, 2008

(87) PCT Pub. No.: WO2007/068363

PCT Pub. Date: Jun. 21, 2007

(65) Prior Publication Data

US 2009/0157097 A1 Jun. 18, 2009

(30) Foreign Application Priority Data

Dec. 14, 2005 (DE) ..... 10 2005 059 572

(51) Int. Cl.
*A61B 17/50* (2006.01)

(52) U.S. Cl. ..... 606/133

(58) Field of Classification Search ..... 606/43, 606/131, 133, 210, 211
See application file for complete search history.

(56) References Cited

U.S. PATENT DOCUMENTS 6,730,100 B2 5/2004 Yamaguchi et al.

FOREIGN PATENT DOCUMENTS

| | | |
|---|---|---|
| CH | 662 302 | 9/1987 |
| EP | 0 630 596 | 9/1998 |
| EP | 1 212 960 | 6/2002 |
| EP | 1 316 271 | 6/2003 |
| WO | WO01/97748 | 12/2001 |
| WO | WO2006/027641 | 3/2006 |

*Primary Examiner* — Ryan Severson
*Assistant Examiner* — Ashley Cronin
(74) *Attorney, Agent, or Firm* — David K Mattheis; Kim W Zerby

(57) ABSTRACT

A hair removal appliance includes a hand-held part and interchangeable tool attachments. The hand-held part includes a housing on which various tool attachments are mountable, as well as a drive mechanism which is arranged in the housing and includes a driving element to which a respective tool attachment is adapted to be coupled with its attachment-side driving element. The tool attachments each have a coupling portion of identical construction and are connectable to a complementary coupling portion on the hand-held part of the hair removal appliance. Each of the tool attachments includes a driving element adapted to be coupled to a driving element on the side of the hand-held part.

21 Claims, 4 Drawing Sheets

HAIR-REMOVAL APPLIANCE WITH DIFFERENT TOOL ATTACHMENTS

CROSS-REFERENCE TO RELATED APPLICATIONS

This application is a national phase application under 35 U.S.C. §371 of PCT International Application No. PCT/EP2006/011543, filed Dec. 1, 2006, which claims priority to German Application No. 10 2005 059 572.3, filed Dec. 14, 2005. The contents of each of these applications are incorporated herein by reference in their entirety.

TECHNICAL FIELD

This invention relates to a hair removal appliance, in particular an epilator and/or depilator.

BACKGROUND

In hair removal appliances it is known to mount on the hand-held part of the appliance various tool attachments interchangeably in order to effect the removal of body hairs in a variety of ways. On the one hand, use is made of an epilator head having tweezers-like clamping members which open and close at periodic intervals for capturing and clamping the hairs and plucking them out of the skin with their roots. The latter operation is performed by the tweezers-like clamping members being speedily moved away from the skin after the hair or the hairs are clamped. As a rule, such epilator heads comprise a cylinder adapted to be driven in a rotational motion and having arranged on its circumference spaced clamping members which open and close at periodic intervals in dependence upon the rotational position, so that an epilation is performed by the rotating cylinder.

On the other hand, it is also possible to mount on the hand-held part of such hair removal appliances hair cutter heads which operate in the manner of the long-hair cutter of a shaving apparatus and effect a so-called depilation of the body hairs. In this arrangement, the hair cutting attachment may comprise a blade bar which is movable in a translational reciprocating motion across a shear plate or a shear bar so that body hairs clamped in between are sheared off.

In lieu of using such tool attachments operating according to various principles of operation, it is also possible to use different tool attachments which basically operate according to the same principle of hair removal. Thus it is known, for example, to use different implementations of the afore-mentioned epilator heads which may differ, for example, in the number of clamping members or in the rotational velocity of the clamping cylinder in order to extract the hairs at different intensities.

Problems presenting themselves in this context are the different types of driving motions to be accomplished. On the one hand, this may be just a different rotational velocity of clamping cylinder. On the other hand, however, also entirely different driving motions may be required as, for example, the translational oscillating driving motion of the hair cutting attachment on the one hand and the rotary driving motion of the epilator attachment on the other hand.

To solve these problems, it has already been proposed to install in the respective tool attachments different gearing arrangements in order to be able to couple them to the same drive mechanism in the hand-held part. For example, EP 0 630 596 B1 discloses a hair removal appliance of the type initially referred to in which the respective tool attachments are adapted to be coupled to a driving gear arranged at the forward end of the hand-held part. In order to be able to achieve different driving motions for the hair cutter head and the epilator head, an oscillatory gearing arrangement is installed in the hair cutter head which converts the rotary motion of the drive pinion in the hand-held part into a translational reciprocating motion of the cutter bar. This solution is, however, relatively complex since each tool attachment requires a gearing arrangement of its own when a different driving motion is to be accomplished. Even when the same principle of motion but at different speeds is to be implemented as is the case, for example, when two epilator heads are to be driven at different speeds, the tool attachments still require the installation of corresponding gearing arrangements. This is a disadvantage particularly in cases where the tool attachments have to be replaced in the course of time because of wear.

SUMMARY

In one aspect, a hand-held part of a hair removal appliance, in particular an epilator, features a housing on which various tool attachments are mountable, as well as a drive mechanism, which is arranged in the housing. The drive mechanism includes a driving element, in particular a driving gear, to which a respective tool attachment is adapted to be coupled with an attachment-side driving element. The drive mechanism includes at least two driving elements which are adapted to be coupled to respective tool attachments alternatively.

In another aspect, a set of tool attachments for a hair removal appliance, in particular an epilator and/or depilator, includes at least two interchangeable tool attachments. Each attachment has a coupling portion of identical construction. Each attachment is connectable to a complementary coupling portion on the hand-held part of the hair removal appliance. Each attachment includes a respective driving element which is adapted to be coupled to a driving element on the side of the hand-held part. The driving elements of the different tool attachments are arranged at different locations and/or are orientated differently relative to the identical coupling portions, such that they are adapted to be coupled to different driving elements on the side of the hand-held part.

The hand-held part offers several driving options. This enables each tool attachment to be coupled to its appropriate drive. On the other hand, one and the same tool attachment may also be coupled to different drives, for example, by a position change, in order to obtain different driving speeds on one and the same tool attachment, for example. The drive mechanism on the side of the hand-held part includes at least two driving elements which are adapted to be coupled alternatively to a respective tool attachment. As a result, the option exists to use the one or the other driving element for driving the attachment-side drive train. Both driving elements are arranged to be accessible from outside, preferably in the region of the coupling portion of the hand-held part on which the tool attachments are mounted. The driving element which is not used for the particular application does not transmit a driving motion to the coupled tool attachment, in which case the unused driving element may run idle or, alternatively, may also be turned off. Each driving element alone may drive the particular tool attachment which is mounted.

In order to make sure that the respective tool attachment is coupled to the appropriate one of the two driving elements, the at least two tool attachments of the set of tool attachments are characterized in that their driving elements adapted to be coupled to the drive on the side of the hand-held part are arranged at different locations and/or are orientated differently relative to the identically constructed coupling portions with which they are fastened to the complementary coupling portion of the hand-held part. For example, on the one tool attachment the driving element may be arranged on the left-hand side, and on the other tool attachment on the right-hand side. The different arrangement and/or orientation ensures that the driving element on the attachment side is engageable with only one of the two driving elements on the hand-held part.

In a further aspect, the two driving elements on the side of the hand-held part are differently constructed and/or differently arranged and/or provided for the transmission of different driving motions. For example, when it is desired to obtain only different driving speeds, in particular rotational frequencies, it is generally possible to use identically constructed driving elements which are arranged in parallel relationship also with regard to their motion axis. To obtain the different driving speeds provision may be made in the hand-held part for two separate drive motors and/or two separate gearing arrangements of different construction.

Preferably, however, the two driving elements on the side of the hand-held part are orientated at least differently and may in particular have motion axes pointing in different directions. Furthermore, they themselves may also be constructed differently. Particularly when constructed as gear wheels they may have a different number of teeth, a different diameter or also a different tooth configuration, forming for example, a bevel gear on the one side and a spur gear on the other side.

According to a preferred embodiment, the two driving elements are each constructed as wheels, in particular gear wheels, which are drivable in different directions of rotation as well as at different rotational frequencies.

In order to obtain a construction as simple as possible with regard to the drive mechanism on the side of the hand-held part, the plurality of driving elements of the hand-held part are preferably driven by a shared drive motor. The driving motion provided by the drive motor is divided, so to speak, into several drive trains having said driving elements sitting on their ends on the side of the hand-held part.

In particular, the driving elements may be driven via a respective gearing arrangement by an output element, particularly an output pinion, which sits on the motor shaft of the drive motor.

Generally, the unused driving element of the drive trains on the side of the hand-held part may run idle. To accomplish this, the respective tool attachment may be constructed such that a corresponding recess is provided in the area of its coupling portion with which it is seated onto the hand-held part, or the coupling portion does not reach up to the region of the idling driving element.

In a further aspect, provision may however be made for switching off the unused driving element or, where more than two driving elements are present, for switching off the unused driving elements and to set in operation only the required driving element. For this purpose, the hand-held part advantageously may provide a coupling device by means of which an unused driving element can be decoupled from, and again coupled on, the respective drive train provided in the hand-held part.

In particular provision is made advantageously for an automatic coupling which engages the driving element required for the respective tool attachment when the corresponding attachment is mounted on the hand-held part. In a further aspect, the coupling device may advantageously comprise a mechanical actuator which is actuated by an actuator on the attachment side when an appropriate tool attachment is fitted, thereby causing engagement of the coupling. If another tool attachment is not equipped with the appropriate actuator, the coupling device remains disengaged.

It will be understood, of course, that the concrete implementation of the coupling may be different. In a preferred embodiment, the respective drive train may include a gear wheel movably mounted beyond its rotatability so as to be engageable with and disengageable from a front- or rear-mounted gear wheel. In this arrangement, a pair of mating spur gears may be provided, in which the gear wheel effecting the processes of engagement and disengagement is movable with its face towards and away from its mating gear wheel. The coupling engagement is effected by a relative motion perpendicular to the axis of rotation of the gear or perpendicular to the teeth. This approach also offers itself for a friction gearing arrangement. Alternatively, however, particular provision may be made for the engageable and disengageable gear wheel to be mounted for displacement in the direction of its axis of rotation so that, when constructed as a gear wheel, it is engageable with and disengageable from its meshing gear wheel parallel to the tooth flanks. This may be an advantage in particular when the axis of rotation of said gear wheel extends parallel to the plug-on or mounting direction of the tool attachment. As a result, the gear wheel can be urged simply and directly by the tool attachment itself into its meshing position when the tool attachment is plugged onto the hand-held part in a translational motion.

According to an advantageous embodiment, the displaceably mounted gear wheel is directly engageable with and disengageable from the output gear which sits on the motor shaft of the drive motor of the drive mechanism on the side of the hand-held part.

The coupling device for switching off the unused driving element may be constructed for manual actuation. For example, an actuating lever or actuating switch may be provided which, upon its actuation, enables the movably mounted gear element to be moved into its engagement position and into its non-engagement position. In a further aspect, however, the coupling device comprises a spring device which biases the movably mounted gear element into its non-engagement position. As a result, the coupling device decouples automatically whenever a corresponding tool attachment is not fitted. By contrast, when it is fitted, it urges the coupling device into its engagement position in opposition to the spring bias.

Implementations will be explained in more detail in the following with reference to a preferred embodiment and the accompanying drawings.

DETAILED DESCRIPTION

Figure 1:
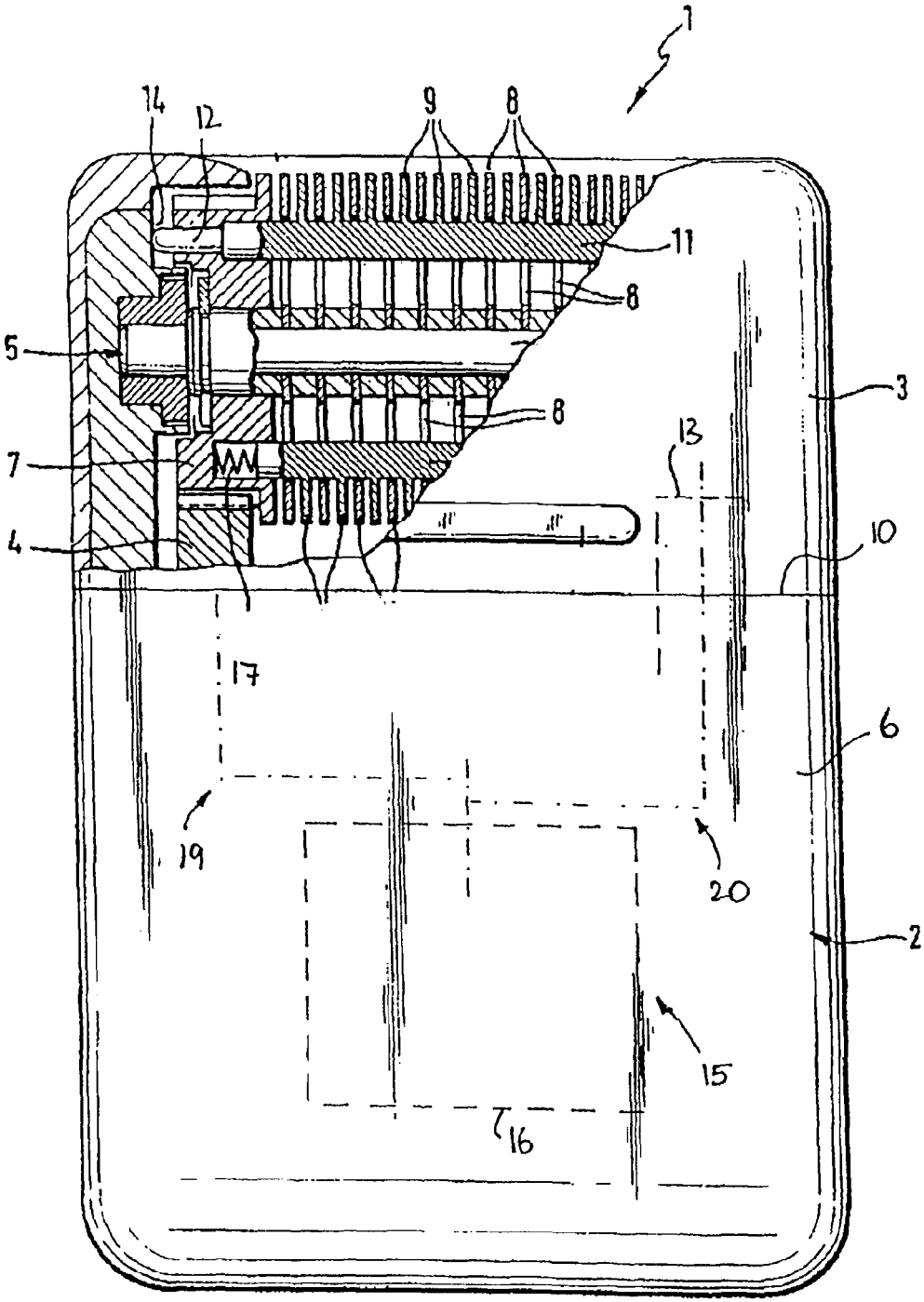
FIG. 1 is a schematic part sectional view of a hair removal appliance having arranged on its hand-held part an epilator attachment comprising a rotary clamping cylinder with movable clamping members.

In the hair removal appliance 1 shown in FIG. 1 its hand-held part 2 has seated on it an epilator attachment for the removal of hairs on the human body according to the epilation principle, which in the embodiment shown includes an epilating cylinder 5 drivable for rotation about a horizontal transverse axis, which cylinder rotates about its longitudinal axis, and where applicable, also oscillates. The epilating cylinder 5 possesses clamping disks 8 fixedly arranged on the cylinder body and extending approximately radially on the circumference of the epilating cylinder 5. Disposed between the clamping disks 8 are circumferentially spaced, roughly tweezers-like clamping elements 9 which in comb-like fashion sit on respective clamping bars 11 which are longitudinally displaceably mounted on the epilating cylinder 5 parallel to the axis of rotation of said cylinder. In this arrangement, the clamping bars 11 protrude with a tappet 12 beyond an end of the body of the epilating cylinder 5 and slide along a cam-shaped cam control surface 14 on the attachment housing, which surface extends annularly about the axis of rotation of the epilating cylinder 5. As a result, each clamping bar 11 and with it the clamping elements 9 are urged cyclically against the clamping disks 8 in accordance with the rotation of the epilating cylinder 5 and are urged away again by a spring 17 arranged opposite the tappet 12, and this at defined locations on the circular path.

To be driven, the epilating cylinder 5 comprises a driving gear 7 which in the embodiment shown is constructed as a spur gear and sits directly on the axis of rotation of the epilating cylinder 5 or is formed by a circumferential section of the epilating cylinder 5. This driving gear 7 on the attachment side is driven by a driving gear 4 on the side of the hand-held part, which in the embodiment shown is likewise constructed as a spur gear and is mounted on the housing 6 of the hand-held part 2 for rotation about an axis of rotation parallel to the axis of rotation of the epilating cylinder 5. As FIG. 1 shows, the driving gear 4 projects out of the housing 6, protruding from the forward end of the hand-held part 2 on the side close to the attachment 3, so that it makes meshing engagement with the driving gear 7 on the attachment side when the attachment 3 is seated down onto the hand-held part 2. To connect the hand-held part 2 with the attachment 3, these comprise complementary coupling portions 10 which generally may differ in construction and preferably form a plug-in connection to enable the attachment 3 to be seated onto the forward end of the hand-held part 2 essentially parallel to the longitudinal axis of the hand-held part.

As indicated in FIG. 1 and shown in the further FIGS. 2 to 5, the hand-held part 2 includes, in addition to said driving gear 4, a further driving gear 13 which is provided for implementing a different driving motion for another tool attachment.

The drive mechanism 15 on the hand-held part, which ends in said two driving gears 4 and 13 on the side of the hand-held part, comprises the drive motor 16 illustrated in greater detail in FIGS. 2 to 5, which may have its motor shaft aligned parallel to the longitudinal axis of the hand-held part 2 and includes an output gear 18 sitting on the motor shaft and constructed as a spur gear in the embodiment shown. The driving motion of the output gear 18 is picked off by two gearing arrangements 19 and 20 which form each a drive train and drive said driving gears 4 and 13 through which the respective drive train is adapted to be coupled with the attachment fitted in the respective case.

As becomes clear from FIGS. 2 to 5, the first gearing arrangement 19 via which the driving gear 4 is driven is permanently coupled to the output gear 18 of the drive motor 16. In this arrangement, the gearing arrangement 19 comprises two gears driving the driving gear 4 at the output end, said gears reducing the rotational frequency of the drive motor 16 to the desired rotational frequency of the driving gear 4.

Figure 2:
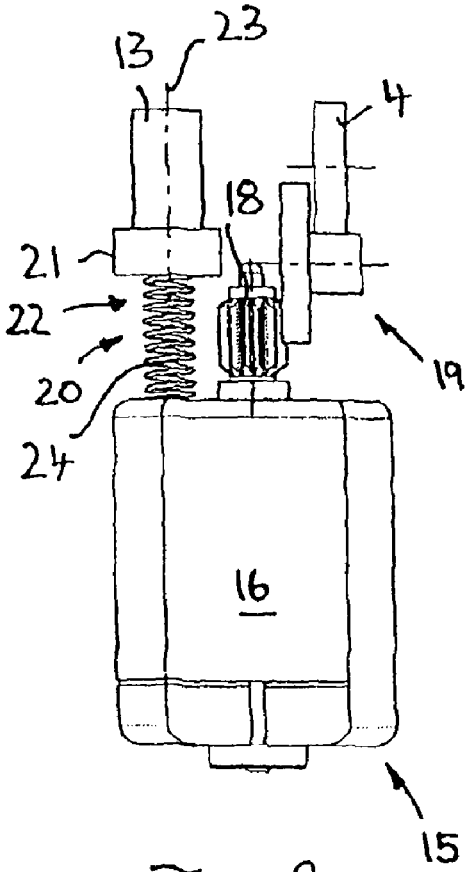
FIG. 2 is a schematic view of the drive mechanism, on the side of the hand-held part, of the appliance of FIG. 1, showing the drive train for a hair cutting attachment in decoupled condition.
Figure 3:
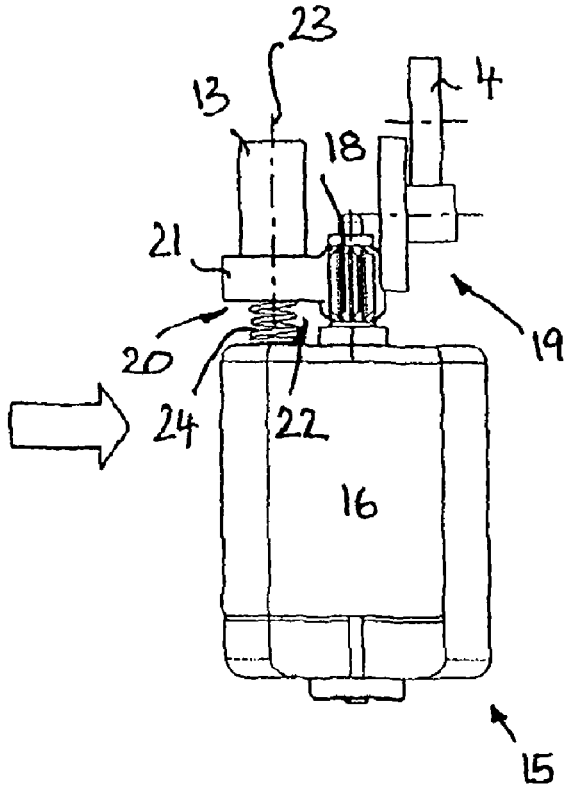
FIG. 3 is a schematic view of the drive mechanism similar to FIG. 2, showing the drive train for the hair cutting attachment in coupled condition.
Figure 4:
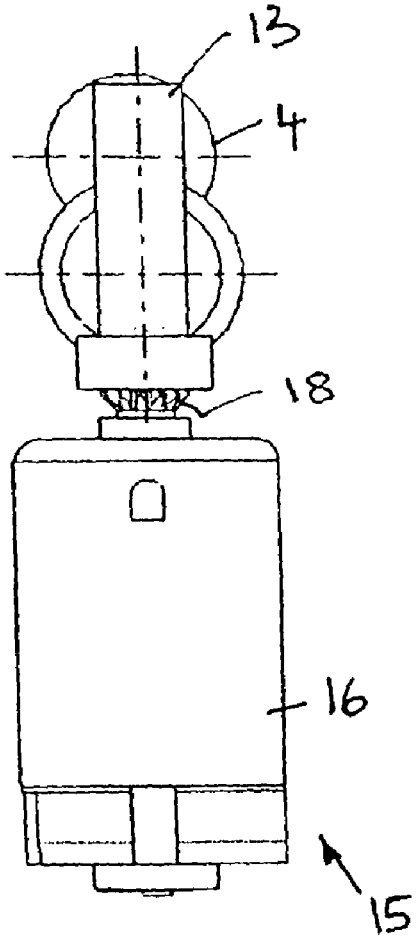
FIG. 4 is a schematic side view of the drive mechanism of FIG. 3, showing the engageable and disengageable drive train.
Figure 5:
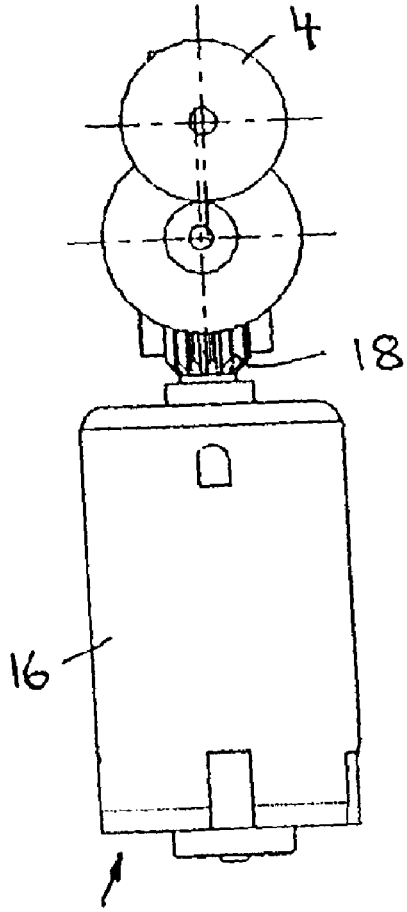
FIG. 5 is a schematic side view of the drive mechanism of FIG. 3 and FIG. 4, showing the permanently coupled drive train.

The second gearing arrangement 20 comprises only one spur gear. One spur gear 21 meshes with the output gear 18 sitting on the motor shaft and drives the previously mentioned driving gear 13 which is rigidly connected to the spur gear 21. As a comparison of FIGS. 2 and 3 shows, the gearing arrangement 20 is constructed to be disengageable. The corresponding coupling device 22 is formed by said spur gear 21 and its movable mounting. In the embodiment shown, the spur gear 21 is displaceably mounted parallel to its axis of rotation 23 so that it is movable out of meshing engagement with the output gear 18 sitting on the motor shaft, such movement occurring essentially parallel to the teeth of the spur gear. In this arrangement, the coupling device 22 comprises a spring device 24 which urges the spur gear 21 with the driving gear 13 sitting thereon into the decoupled position. Advantageously, the coupling motion takes place essentially perpendicular to the forward end of the hand-held part 2 onto which the respective attachment 3 is seated. In other words, in said construction of the coupling portions 10 between the attachment and the hand-held part 2, the coupling motion takes place parallel to the plug-on direction of the attachment 3, so that when an appropriate tool attachment is fitted the gearing arrangement 20 is pressed down in opposition to the bias of the spring device 24 and is coupled, i.e., moved into meshing engagement with the output gear 18.

Figure 6:
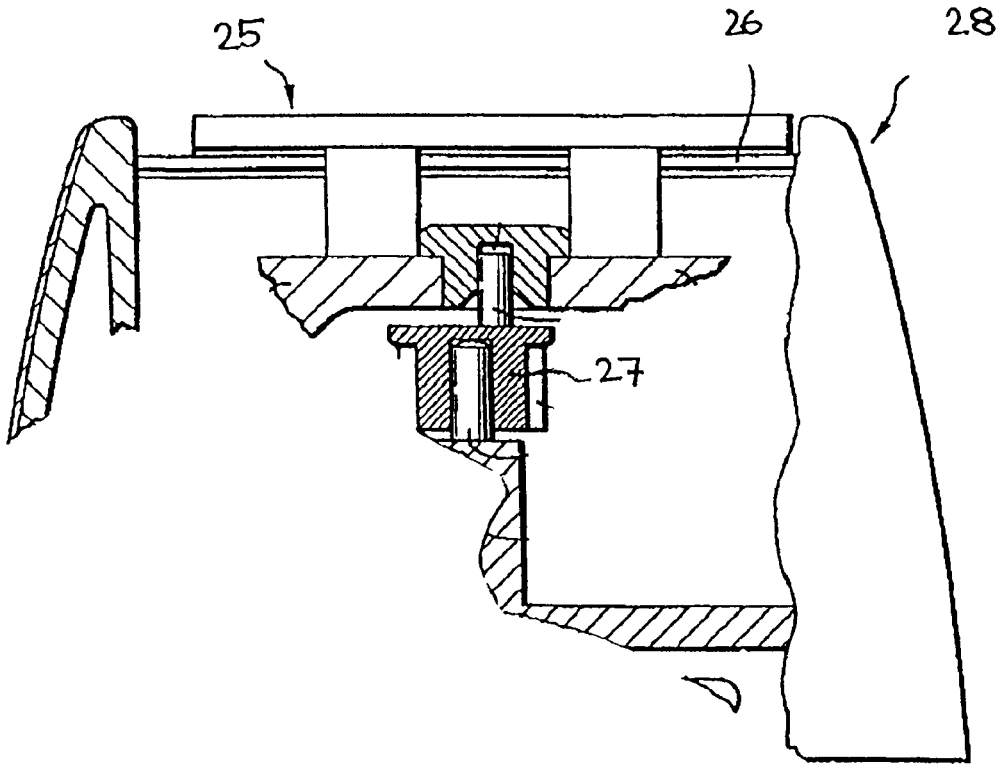
FIG. 6 is a schematic part sectional view of a hair cutting attachment with an oscillatory blade bar.

As FIG. 3 shows, the two driving gears 4 and 13 provided by the hand-held part 2 are not only differently constructed but also differently aligned. While the driving gear 4 is capable of rotating about a horizontal axis, i.e., an axis aligned perpendicular to the longitudinal axis of the hand-held part 2, the axis of rotation of the driving gear 13 extends essentially parallel to the longitudinal axis of the hand-held part 2. In addition, the gearing arrangement 20 is constructed to be less reducing than the gearing arrangement 19 so that the rotational frequency of the driving gear 13 is considerably higher than the rotational frequency of the driving gear 4. This makes it possible to drive with the driving gear 13 in particular a hair cutting attachment with shear bar of the type shown, for example, in FIG. 6 with a substantially higher oscillation frequency. This hair cutting attachment 28 comprises a cutter or blade bar 25 which is mounted for translational reciprocating motion parallel to its longitudinal direction and sits on a shear bar 26 or sweeps across it in a reciprocating motion, so that hairs clamped in between are cut off. Said blade bar 25 is driven to reciprocate by an eccentric gear 27 which is movable into meshing engagement with the previously described driving gear 13 of the hand-held part 2 when the hair cutting attachment is fitted onto the hand-held part.

It will be understood that the set of attachments for the hair removal appliance described is not limited to the two embodiments of tool attachments shown by way of example. Peeling attachments, massaging attachments and the like may also find application.

The invention claimed is

1. A hair removal appliance comprising:

a housing configured to be held by a user;

a drive mechanism arranged in the housing, the drive mechanism comprising a motor, a drive train, and two driving elements engageable with the drive train; a coupler for reversibly coupling at least one of the driving elements to the drive train; and a tool attachment mountable to the housing, the tool attachment comprising an attachment driving element, wherein the attachment driving element is adapted to couple to a first one of the two driving elements to drive the tool attachment and the coupler is actuatable by the tool attachment.

2. The appliance of claim 1, wherein the two driving elements are adapted to provide for the transmission of different driving motions.

3. The appliance of claim 1, wherein each of the two driving elements comprises a gear wheel.

4. The appliance of claim 3, wherein the gear wheels are drivable in different directions of rotation.

5. The appliance of claim 3, wherein the gear wheels are drivable at different rotational frequencies.

6. The appliance of claim 1, wherein the drive motor is a shared drive motor for the two driving elements.

7. The appliance of claim 6, further comprising a motor shaft output gear coupled to the drive motor and a gearing arrangement for each of the two driving elements, wherein the motor shaft output gear is arranged to drive each of the two driving elements.

8. The appliance of claim 1, wherein the drive train comprises a gear wheel, the coupler comprises a gear wheel, and the gear wheel of the coupler is reversibly engageable with the gear wheel of the drive train.

9. The appliance of claim 8, wherein the coupler gear wheel is arranged to slide along an axis of motion to engage the drive train gear wheel during mounting of the tool attachment on the housing.

10. The appliance of claim 9, wherein the housing comprises a plug connector portion for mounting the tool attachment, the plug connector portion arranged such that mounting of the tool attachment includes relative movement of the tool attachment toward the housing in a direction that is substantially parallel to the motion axis of the coupler.

11. The appliance of claim 8, wherein the drive train gear wheel comprises an output pinion coupled to a shaft of the motor.

12. The appliance of claim 1, wherein the coupler is spring biased.

13. The appliance of claim 1, wherein an axis of rotation of a first one of the two driving elements is substantially perpendicular to an axis of rotation of a second one of the two driving elements.

14. The appliance of claim 1, wherein the tool attachment comprises an epilator.

15. The appliance of claim 1, wherein the tool attachment comprises a depilator.

16. The appliance of claim 1, wherein the tool attachment comprises a coupling portion for mounting to the housing.

17. The appliance of claim 1, further comprising a second tool attachment, the second tool attachment comprising a coupling portion for mounting to the housing and a second tool attachment driving element adapted to couple to a second one of the two driving elements to drive the second tool attachment.

18. The appliance of claim 17, wherein the second tool attachment is physically interchangeable with the tool attachment.

19. The appliance of claim 18, wherein the tool attachments comprise:

an epilator attachment, the epilator attachment comprising an epilator cylinder drivable in a rotary motion; and a hair cutting attachment comprising a shear blade drivable in an oscillatory motion.

20. A hair removal appliance kit comprising:

a housing configured to be held by a user;

a drive mechanisms arranged in the housing, the drive mechanism comprising a motor, a drive train, a first driving element, and a second driving element, each driving element engageable with the drive train; a coupler for reversibly coupling at least one of the driving elements to the drive train; and a first tool attachment and a second tool attachment, the tool attachments comprising substantially identical coupling portions for interchangeably mounting the tool attachments to the housing, and each tool attachment comprising an attachment driving element, wherein:

the attachment driving element of the first tool attachment is adapted to couple to the first driving element, the coupler is actuatable by the tool attachment, the attachment driving element of the second tool attachment is adapted to couple to the second driving element, and the attachment driving element of the first tool attachment and the attachment driving element of the second tool attachment are oriented differently with respect to the coupling portion of the tool attachments.

21. The hair removal appliance kit of claim 20, wherein the first tool attachment comprises an epilator with an epilating cylinder drivable in a rotary motion, and the second tool attachment is a hair cutting attachment comprising a shear blade drivable in an oscillatory motion.

* * * * *